US006783729B2

(12) United States Patent
Major et al.

(10) Patent No.: US 6,783,729 B2
(45) Date of Patent: Aug. 31, 2004

(54) ALUMINUM ALLOY FOR MAKING NATURALLY AGED DIE CAST PRODUCTS

(75) Inventors: J. Fred Major, Kingston (CA); Lawrence Purdon, Inverary (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 10/315,535

(22) Filed: Dec. 10, 2002

(65) Prior Publication Data

US 2003/0111139 A1 Jun. 19, 2003

Related U.S. Application Data

(60) Provisional application No. 60/339,680, filed on Dec. 11, 2001.

(51) Int. Cl.[7] ..... C22C 21/00
(52) U.S. Cl. ..... 420/541; 148/415
(58) Field of Search ..... 420/541; 148/415

(56) References Cited

U.S. PATENT DOCUMENTS 5,122,196 A * 6/1992 Fernandez ..... 148/552
5,573,606 A 11/1996 Evans et al. ..... 148/440

FOREIGN PATENT DOCUMENTS

JP S53-56115 5/1978
JP S54-65110 5/1979

OTHER PUBLICATIONS

B. Chamberlain et al., "A Natural Aging Aluminum Alloy, Designed for Permanent Mold Use", AFS Transactions, 77–111, p. 133–142 (1977).

* cited by examiner

*Primary Examiner*—George Wyszomierski
*Assistant Examiner*—Janelle Morillo
(74) *Attorney, Agent, or Firm*—Cooper & Dunham LLP

(57) ABSTRACT

Aluminum alloy die castings combine good as-cast strength with good as-cast ductility, without any heat treatment. The alloy comprises 2.75 5.25 wt. % magnesium, 1.85–3.15 wt. % zinc, 0.65–1.2 wt. % manganese, 0.10–0.18 wt. % iron, less than 0.10 wt. % copper, less than 0.10 wt. % silicon, less than 0.20 wt. % titanium and the balance aluminum and incidental impurities and furthermore the percent by weight magnesium is greater than or equal to the percent by weight zinc. A particularly high strength version of the alloy comprises 4.75%–5.25 wt. % magnesium and 2.85–3.15 wt. % zinc. A particularly high ductility version of the alloy comprises 2.75–3.25 wt. % magnesium, 1.85 2.5 wt. % zinc.

6 Claims, No Drawings

ALUMINUM ALLOY FOR MAKING NATURALLY AGED DIE CAST PRODUCTS

CROSS-REFERENCE TO RELATED APPLICATION

This application claims the benefit of Provisional Application Ser. No. 60/339,680, filed Dec. 11, 2001.

FIELD OF THE INVENTION

This invention relates to aluminum base die casting alloys which provide good mechanical properties with conventional die casting machines without the need for heat treatment.

BACKGROUND OF THE INVENTION

Aluminum alloys are now being widely used in manufacturing industries, and particularly the automotive industry, as a lightweight alternative to ferrous materials. In addition to having good strength characteristics, these aluminum alloys must have good die casting characteristics and be readily machinable.

A typical aluminum alloy for this purpose is an Al—Mg—Si type alloy as described in Evans et al., U.S. Pat. No. 5,573,606, issued Nov. 12, 1996. This aluminum alloy typically contains about 2.5–4.0 wt. % magnesium, 0.2–0.4 wt. % manganese, 0.25–0.6 wt. % iron and 0.2–0.45 wt. % silicon. This alloy is preferably cast in a vertical-type die casting machine.

Chamberlain et al. "A Natural Aging Aluminum Alloy, Designed for Permanent Mold Use", AFS Transactions, Vol. 111, p. 133–142 (1977) describes the use of Al—Mg—Zn alloys for producing castings in a permanent mold. A typical alloy for this purpose contains about 3.3 wt. % magnesium, 2.9 wt. % zinc and 0.06 wt. % titanium. It was found that this alloy has limited use for some low-pressure die casting work.

An Al—Mg—Zn alloy particularly intended for die casting is described in Takeuchi et al., Japanese Patent Publication S61-28739, laid open Jul. 2, 1986. This alloy contains 0.5 2.5 wt. % zinc, 0.5–3.0 wt. % magnesium, 0.2–1.2 wt. % silicon, 0.2–1.5 wt. % iron, 0.1–1.2 wt. % manganese and the balance aluminum and incidental impurities.

Standard die castings exhibit far too low a ductility, e.g. about 2–3%, to be considered useful for structural applications. There are advanced, and expensive, die casting techniques and alloys that help the problem. However, they also require a heat treatment step which further adds to the cost. There is, therefore, a need for alloys and/or procedures which can provide good mechanical properties with conventional die casting machines without the need for heat treatment.

It is an object of the present invention to produce an aluminum alloy having low contents of copper, silicon and iron and which when cast in a conventional die casting machine has excellent as-cast strength without any need for heat treatment.

It is a further object of the present invention to produce an aluminum alloy having low contents of copper, silicon and iron and which when cast in a conventional die casting machine has improved as-cast ductility.

SUMMARY OF THE INVENTION

According to one embodiment of this invention, an aluminum alloy for die casting comprises 2.75–5.25 wt. % magnesium, 1.85–3.15 wt. % zinc, 0.65–1.2 wt. % manganese, 0.10–0.18 wt. % iron, less than 0.10 wt. % copper, less than 0.10 wt. % silicon, less than 0.20 wt. % titanium and the balance aluminum and incidental impurities where the ratio of weight percent Mg to weight percent Zn is greater than or equal to 1. This alloy exhibits improved strength and ductility after die casting and age hardening without a heat treatment when compared to similar die casting alloys based on higher Fe and lower Mn.

According to a further embodiment of this invention, an aluminum alloy for die casting comprises 4.75–5.25 wt. % magnesium, 2.85–3.15 wt. % zinc, 0.65–1.2 wt. % manganese, 0.10–0.18 wt. % iron, less than 0.10 wt. % copper, less than 0.10 wt. % silicon, less than 0.20 wt. % titanium and the balance aluminum and incidental impurities. This alloy exhibits excellent as-cast strength properties. After die casting and age hardening and without a heat treatment, the die cast product has a 0.2% offset yield strength (YS) of at least about 170 MPa, an ultimate tensile strength of at least about 280 MPa and an elongation value of at least about 5%.

According to yet a further embodiment of this invention, an aluminum alloy for die casting comprises 2.75–3.25 wt. % magnesium, 1.85–2.5 wt. % zinc, 0.65–1.2 wt. % manganese, 0.10–0.18 wt. % iron, less than 0.10 wt. % copper, less than 0.10 wt. % silicon, less than 0.20 wt. % titanium and the balance aluminum and incidental impurities. Compared to the above alloy, this one provides quite good strength properties together with excellent as-cast ductility. After die casting and age hardening and without a heat treatment, the die cast product has a 0.2% offset yield strength of at least about 130 MPa, an ultimate tensile strength of at least about 240 MPa and an elongation value of at least about 12%.

It is a surprising feature of this invention that with very low levels of copper, silicon and iron, the presence of manganese in place of iron serves to increase the yield strength and ultimate tensile strength without having an adverse effect on the ductility (elongation).

DESCRIPTION OF THE PREFERRED EMBODIMENTS

Considerable is known about the purpose of the various components in the above alloys and, for instance, magnesium is used to enhance the tensile strength of the alloy. Zinc also improves the alloy strength, while improving fluidity during casting. When magnesium and zinc are selected within the range of the present invention, a useful combination of strength and ductility is obtained. If the magnesium and/or zinc is higher than the inventive range, then the ductility is reduced to an unacceptable level and if the magnesium and/or zinc is less than the inventive range, then the strength is too low, even when enhanced by the manganese.

The amount of magnesium should be greater than or equal to the amount of zinc. It is believed that with magnesium and zinc levels of the present invention and with magnesium greater than or equal to zinc, an Al—Mg—Zn phase forms which creates fine precipitates even at room temperature, and these contribute to the increased strength but do not adversely affect the elongation. A level of magnesium greater than or equal to the level of zinc also increases the resistance to corrosion and hot shortness.

Within the broad range of magnesium and zinc it is possible to provide levels of magnesium or zinc that further enhance the strength or the ductility, but in both cases, the present of manganese at low iron, etc. provides further enhancement of the strength without being detrimental to the ductility.

Iron is typically added to counteract die soldering and manganese counteracts some negative effects of the iron as well as, itself, counteracting die soldering. In the present alloy, iron must be kept low (less than 0.18% by weight) since the combined effect at a higher iron with the manganese would be negative on the ductility.

Too much silicon can be up magnesium as $Mg_2Si$ that prevents formation of the desired Al—Mg—Zn phase. Titanium may be totally absent from the die casting alloys and is generally present in less than 0.12%. Low levels of copper are preferred to help avoid corrosion.

The alloys of this invention are useful for forming light weight die cast articles having as-cast mechanical properties superior to standard die cast alloys without the need for heat treatment. They are particularly useful for the production of structural and high integrity die castings for the automobile industry.

EXAMPLE 1

A series of four different aluminum alloys were prepared having the compositions set out in Table 1 below:

TABLE 1

| | Alloy #1 | Alloy #2 | Alloy #3 | Alloy #4 |
|---|---|---|---|---|
| Si (wt %) | 0.05 | 0.05 | 0.05 | 0.04 |
| Mg (wt %) | 4.99 | 5.12 | 2.95 | 2.98 |
| Fe (wt %) | 0.75 | 0.16 | 0.79 | 0.15 |
| Mn (wt %) | — | 0.75 | — | 0.88 |
| Zn (wt %) | 2.99 | 3.02 | 2.02 | 1.98 |

The above alloys were die cast into separately die cast tensile bars using a Buhler SC600 die casting machine. The bars were aged for 21 days at room temperature after which the mechanical properties were determined. The results obtained are shown in Table 2 below:

TABLE 2

| | Alloy #1 | Alloy #2 | Alloy #3 | Alloy #4 |
|---|---|---|---|---|
| U.T.S. (MPa) | 277 | 294 | 236 | 257 |
| 2% Y.S. (MPa) | 160 | 179 | 120 | 141 |
| % Elong. | 6.86 | 6.43 | 12.6 | 15.8 |

Alloys #2 and #4, both of which contain more than 0.65 wt % Mn, show increased yield and tensile strength in comparison to Alloys #1 and #3 which contain only Fe to counteract die soldering. It is particularly noteworthy that this was accomplished with almost no degradation of ductility for Alloy #2 compared to Alloy #1 and, moreover, there was an actual increase in ductility for Alloy #4 compared to Alloy #3. This is most surprising since it is the conventional wisdom of those skilled in the art that one trades ductility for strength in casting alloys.

We claim:

1. A die cast aluminum alloy article of manufacture, said alloy comprising:

2.75–5.25% by weight magnesium;

0.65–1.2% by weight manganese;

0.10–0.18% by weight iron;

1.85–3.15% by weight zinc;

a maximum of 0.10% by weight copper;

a maximum of 0.10% by weight silicon;

a maximum of 0.20% by weight titanium; and the remainder being aluminum and incidental impurities, said alloy having a ratio by weight of magnesium to zinc of greater than or equal to 1.

2. A die cast aluminum alloy article of manufacture as in claim 1 containing:

4.75–5.25% by weight magnesium and 2.85–3.15% by weight zinc;

said alloy having an ultimate tensile strength of at least 280 MPa.

3. A die cast aluminum alloy article of manufacture as in claim 1 containing:

2.75–3.25% by weight magnesium and 1.85–2.15% by weight zinc;

said alloy having an elongation of at least 12%.

4. A die cast aluminum alloy article of manufacture wherein said aluminum alloy comprises:

2.75–5.25% by weight magnesium;

0.65–1.2% by weight manganese;

0.10–0.18% by weight iron;

1.85–3.15% by weight zinc;

a maximum of 0.10% by weight copper;

a maximum of 0.10% by weight silicon;

a maximum of 0.20% by weight titanium; and the remainder being aluminum and incidental impurities, said alloy having a ratio by weight of magnesium to zinc of greater than or equal to 1; and said die cast article having after aging at room temperature and without heat treatment a 0.2% offset yield strength of at least about 130 MPa, an ultimate tensile strength of at least about 240 MPa and an elongation value of at least about 5%.

5. A die cast aluminum alloy article of manufacture as in claim 4 wherein said aluminum alloy contains:

4.75–5.25% by weight magnesium and 2.85–3.15% by weight zinc;

said die cast article having after aging at room temperature and without heat treatment a 0.2% offset yield strength of at least about 170 MPa, an ultimate tensile strength of at least about 280 MPa and an elongation value of at least about 5%.

6. A die cast aluminum alloy article of manufacture as in claim 4 wherein said aluminum alloy contains:

2.75–3.25% by weight magnesium and 1.85–2.15% by weight zinc;

said die cast article having after aging at room temperature and without heat treatment a 0.2% offset yield strength of at least about 130 MPa, an ultimate tensile strength of at least about 240 MPa and an elongation value of at least about 12%.

* * * * *